US009079322B2

(12) United States Patent
Demand

(10) Patent No.: US 9,079,322 B2
(45) Date of Patent: Jul. 14, 2015

(54) DEVICE FOR THE ROTARY DIECUTTING OF FLAT MULTI-LAYERED GOODS

(75) Inventor: Thomas Demand, Wetzlar (DE)

(73) Assignee: Gallus Druckmaschinen GmbH, Langgoens-Oberkleen (DE)

( * ) Notice: Subject to any disclaimer, the term of this patent is extended or adjusted under 35 U.S.C. 154(b) by 498 days.

(21) Appl. No.: 13/179,593

(22) Filed: Jul. 11, 2011

(65) Prior Publication Data

US 2012/0006212 A1 Jan. 12, 2012

(30) Foreign Application Priority Data

Jul. 9, 2010 (DE) ..... 10 2010 026 607

(51) Int. Cl.
*B26F 1/20* (2006.01)
*B26F 1/38* (2006.01)
*B26D 7/26* (2006.01)

(52) U.S. Cl.
CPC ..... *B26D 7/2628* (2013.01); *B26D 7/265* (2013.01)

(58) Field of Classification Search
CPC ..... B26D 7/265; B26D 7/2628; B41F 13/30; F16C 19/55
USPC ..... 101/5, 6, 23, 24, 218, 247; 83/343, 344, 83/331, 345, 346; 384/461, 247
See application file for complete search history.

(56) References Cited

U.S. PATENT DOCUMENTS 3,731,620 A * 5/1973 Klemmer ..... 101/23
4,171,655 A * 10/1979 Voorhees ..... 83/344
4,226,150 A * 10/1980 Reed ..... 83/346
4,359,919 A 11/1982 Fuchs et al.
4,831,929 A * 5/1989 Saito ..... 101/230
5,156,076 A * 10/1992 Rosemann ..... 83/344
5,388,490 A * 2/1995 Buck ..... 83/880
7,594,461 B2 * 9/2009 Aichele et al. ..... 83/344
7,971,525 B2 7/2011 Leins
2001/0020407 A1 * 9/2001 Grafe et al. ..... 83/13
2006/0156934 A1 7/2006 Arabin et al.

(Continued)

FOREIGN PATENT DOCUMENTS

CN 1852806 A 10/2006
DE 66 02 393 U 5/1969

(Continued)

OTHER PUBLICATIONS

German Patent and Trademark Office Search Report, Dated Jan. 24, 2011.

*Primary Examiner* — Blake A Tankersley
*Assistant Examiner* — Quang X Nguyen
(74) *Attorney, Agent, or Firm* — Laurence A. Greenberg; Werner H. Stemer; Ralph E. Locher

(57) ABSTRACT

A diecutting device, in particular for cutting labels, includes a diecutting cylinder that rotates about an axis of rotation, a counterpressure cylinder that rotates about an axis of rotation essentially parallel to the axis of rotation of the diecutting cylinder and has a cylinder body, and bearer rings assigned to the cylinders and rolling off on each other. A spacing between the diecutting cylinder and the counterpressure cylinder is adjustable. A respective bearer ring assigned to the counterpressure cylinder is connected to a counterpressure cylinder shaft and each end of the cylinder body of the counterpressure cylinder is connected to the counterpressure cylinder shaft by a respective connecting link guide.

12 Claims, 4 Drawing Sheets

(56) References Cited

U.S. PATENT DOCUMENTS

| | | | | |
|---|---|---|---|---|
| 2007/0101844 | A1* | 5/2007 | Spilker | 83/344 |
| 2009/0107315 | A1* | 4/2009 | Leins | 83/346 |
| 2009/0223394 | A1* | 9/2009 | Bangel et al. | 101/217 |
| 2011/0036217 | A1* | 2/2011 | Schneider | 83/13 |

FOREIGN PATENT DOCUMENTS

| | | | |
|---|---|---|---|
| DE | 6602393 | U | 5/1969 |
| DE | 29 12 458 | A1 | 10/1980 |
| DE | 297 15 037 | U1 | 11/1997 |
| DE | 198 14 009 | C1 | 6/1999 |
| DE | 10 2005 016 779 | A1 | 12/2005 |
| DE | 10 2004 032 030 | A1 | 1/2006 |
| DE | 10 2004 033 032 | A1 | 2/2006 |
| DE | 10 2005 060 587 | A1 | 7/2007 |
| DE | 10 2006 016 410 | B3 | 11/2007 |
| DE | 10 2007 057 188 | A1 | 11/2008 |
| DE | 10 2007 062 936 | A1 | 7/2009 |
| EP | 0 899 068 | A2 | 3/1999 |
| WO | 2006116954 | A1 | 11/2006 |

* cited by examiner

DEVICE FOR THE ROTARY DIECUTTING OF FLAT MULTI-LAYERED GOODS

CROSS-REFERENCE TO RELATED APPLICATION

This application claims the priority, under 35 U.S.C. §119, of German application DE 10 2010 026 607.8, filed Jul. 9, 2010; the prior application is herewith incorporated by reference in its entirety.

BACKGROUND OF THE INVENTION

Field of the Invention

The invention relates to a diecutting device which is used for diecutting flat multi-layered goods and contains a diecutting cylinder and a counterpressure cylinder. At least one layer of the flat multi-layered good may be diecut in a diecutting nip formed between the diecutting cylinder and the counterpressure cylinder without severing all layers completely, and the width of the diecutting nip is adjustable.

In the present description the term "to diecut" is understood to include both diecutting in the narrower sense of "severing", "perforating", or "punching" and in the broader sense of "embossing", i.e. "deform" or "impress". The same applies to similar grammatical constructions such as "diecuttable", which is to be understood to mean "severable", "perforatable", or "punchable", in the narrower sense of the word as well as "embossable", "deformable", or "impressable" in the broader sense of the word. The exclusive use of the term "diecut" and its grammatical derivations is intended to simplify the description but not to exclude the connotations indicated above or to limit the description in any way. Moreover, in the following description, the terms "diecutter", "diecutting device", and "diecutting machine" will be used synonymously.

When flat multi-layered goods such as self-adhesive labels are to be diecut, in particular in a diecutting device in a printing press, an upper material, i.e. a printing material located on the top (the actual label material) and an adhesive layer need to be diecut (in particular severed) without harming (in particular severing) a release layer that is underneath. The diecutting process depends on the material to be processed, i.e. the device, especially the positions of its components or the diecutting depth, needs to be modified or adjusted to be able to adjust the diecutting depth in a range between a few micrometers and some tenths of a millimeter. Usually the diecutting is done in a rotary diecutter (rotary diecutting unit) or a rotary embosser (rotary embossing unit). In a diecutting nip formed between a diecutting cylinder that carries a cutting die or an embossing plate and a counterpressure cylinder, the cutting die or embossing plate acts upon the flat multi-layered good which is plastically changed, for instance severed or embossed. The flat multi-layered good may in particular be web-shaped.

German patent DE 6602393 discloses that the diecutting cylinder and the counterpressure cylinder of a diecutting device may be equipped with bearer rings that roll on each other so the diecutting cylinder and the counterpressure cylinder support each other. The adjustability of the diecutting nip and thus the cutting depth is achieved by varying the contact pressure, which may result in considerable deformation of the bearer rings. In the diecutting process, high pressure peaks may occur and may cause a temporary deformation of the diecutting frame which supports the bearings. If the width of the diecutting nip changes due to this deformation, the quality of the diecutting operation will deteriorate. A preloading of the bearer rings at a high contact pressure causes premature wear to bearer rings, rolling surfaces, and bearings.

A disadvantage of such a solution is, however, that the level of the blades of a cutting die or embossing plate received on the diecutting cylinder must be chosen to match the size of the bearer rings and the height of the release material. In other words, a specific cutting tool adapted to the specific diecutting device to be used must be created for each job.

Alternatively, German Utility Model DE 297 15 037 U1 discloses mechanical fine adjustment using conical rollers mounted to the axes of the diecutting cylinders and counterpressure cylinders. The conical rollers engage each other in such a way that at least one of the axes is radially and axially displaceable relative to the other in a simultaneous or correlated manner to vary the width of the diecutting nip.

U.S. Pat. No. 4,359,919 discloses to provide further bearings for the diecutting cylinder and the counterpressure cylinder which support each other on contact surfaces in an intermediate piece. A contact surface of one of the two bearings supporting each other is configured to be inclined and a wedge-shaped element is provided between the contact surfaces to vary the thickness of the intermediate piece by varying the position of the wedge-shaped element.

Further mechanical fine adjustments are known in the prior art to adjust the cutting nip in the micrometer range. Such a mechanical fine-adjustment is typically achieved using eccentrically adjustable bearer rings. Such a device is disclosed, for instance, in published European patent application EP 0 899 068 A2 and German patent DE 198 14 009 C1.

Further diecutting devices are disclosed in published, non-prosecuted German patent applications DE 10 2005 016 779A1, DE 10 2007 062 936 A1, DE 10 2005 060 587 A1, DE 10 2007 057 188 A1, DE 10 2004 033 032 A1, and DE 29 12 458 OS, corresponding to U.S. Pat. No. 4,359,919.

A disadvantage of the known diecutters that allow adjustment of the spacing between diecutting cylinder and counterpressure cylinder is that only short adjustment paths are possible. It is not possible to space the cylinders far enough apart to make adjustments to the cutting register. Another disadvantage is that an adjustment of the spacing between the two cylinders is frequently accompanied by a slight transverse displacement of one of the cylinders, thus resulting in register deviations.

SUMMARY OF THE INVENTION

It is accordingly an object of the invention to provide a device for the rotary diecutting of flat multi-layered goods which overcome the above-mentioned disadvantages of the prior art devices of this general type, which allows easy and accurate adjustment of the spacing between a diecutting cylinder and a counterpressure cylinder.

In accordance with the invention, a diecutting device, which can in particular be used to diecut or punch labels, includes a diecutting cylinder rotatable about an axis of rotation and a counterpressure cylinder rotatable about an axis of rotation. The axes of rotation of the diecutting and counterpressure cylinders are generally parallel. The counterpressure cylinder has a cylinder body that is in particular configured as a hollow cylinder. Bearer rings rolling off on each other are assigned to each cylinder. Advantageously, a respective bearer ring assigned to the counterpressure cylinder is connected to a counterpressure cylinder shaft. Both ends of the cylinder body of the counterpressure cylinder are connected to the counterpressure cylinder shaft by a respective connecting link guide. Due to this construction, the spacing between the diecutting cylinder and the counterpressure cylinder is adjustable.

In accordance with an alternative embodiment of the invention which will not be described in more detail, both ends of the cylinder body of the counterpressure cylinder are connected to a respective bearer ring assigned to the counterpressure cylinder by a respective connecting link guide and the cylinder body is thus mounted for rotation.

In accordance with an advantageous and thus particularly preferred embodiment of the invention, the cylinder body of the counterpressure cylinder is linearly movable relative to the counterpressure cylinder shaft, in particular in an exclusively vertical, i.e. perpendicular, direction. An advantage of this linear adjustment is that, in contrast to an eccentric adjustment as known from the prior art, the cutting register does not change. Another advantage over the eccentric adjusting devices of the prior art is that adjustments in the range of one hundredth of a millimeter and adjustments in the range of approximately 1 to 2 mm are equally possible. An adjustment in the range of one hundredth of a millimeter, which may be made in increments of a thousandth of a millimeter, is used to adjust the cutting depth. An adjustment in the millimeter range is made to completely disengage the counterpressure cylinder without having to move or disengage the gearwheels of the drive train. If the diecutting device includes a pressure bridge, the latter does not have to be released either. An adjustment in the millimeter range not only provides quick disengagement but also a rough register adjustment of the cylinders in a disengaged state. Another advantage of the device of the invention is that when the counterpressure cylinder is worn, only the cylinder body needs to be exchanged and the adjustment mechanism can remain in use. In addition, the adjustment mechanism of the invention only requires centric parts, which are easier to manufacture than the parts with eccentric surfaces that are needed for prior art adjustment mechanisms. Moreover, the device of the invention is capable of absorbing the cutting forces and of keeping the flow of forces at an uncritical level.

In accordance with an advantageous further development of the device of the invention, a respective connecting link guide includes a sliding block mounted for rotation on the counterpressure cylinder shaft and a link for guiding the sliding block. The cylinder body of the counterpressure cylinder is supported for rotation relative to the link.

To provide the rotations, an advantageous further development of the invention includes a roller bearing between the counterpressure cylinder shaft and a respective sliding block. A respective roller bearing may likewise be provided between a respective link and the cylinder body.

In accordance with a further development of the device of the invention the diecutting device includes at least two support roller blocks for mounting the counterpressure cylinder. The spacing between the support rollers of the support roller blocks and the diecutting cylinder is adjustable so the counterpressure cylinder can be engaged with the diecutting cylinder. A particularly advantageous feature is to equip the support rollers with a device for varying the height of the support rollers. The height variation device may be actuated by a motor or by hand. Thus the height of the support rollers may be adjusted for all rollers jointly or individually. Thus the counterpressure cylinder may be adjusted parallel to the diecutting cylinder or at an angle relative to the latter.

In accordance with a variant embodiment of the diecutting device of the invention the bearer rings associated with the counterpressure cylinder are flanged to the counterpressure cylinder shaft so as to be fixed against rotation.

In accordance with an advantageous further development of the diecutting device of the invention a spring system is provided in the area of a respective connecting link guide, in particular a set of Belleville spring washers, to prevent the counterpressure cylinder from lifting off the support rollers of the support roller blocks. In other words, the spring system ensures that the counterpressure cylinder continuously rests on the support rollers.

In accordance with a further development of the diecutting device of the invention, a mechanism to prevent rotation is provided in the area of the connecting link guide to prevent the connecting link from rotating with the cylinder body of the counterpressure cylinder.

The diecutting device described above may be used in a label printing machine, in particular a flexographic printing press, for diecutting labels.

Other features which are considered as characteristic for the invention are set forth in the appended claims.

Although the invention is illustrated and described herein as embodied in a device for the rotary diecutting of flat multilayered goods, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
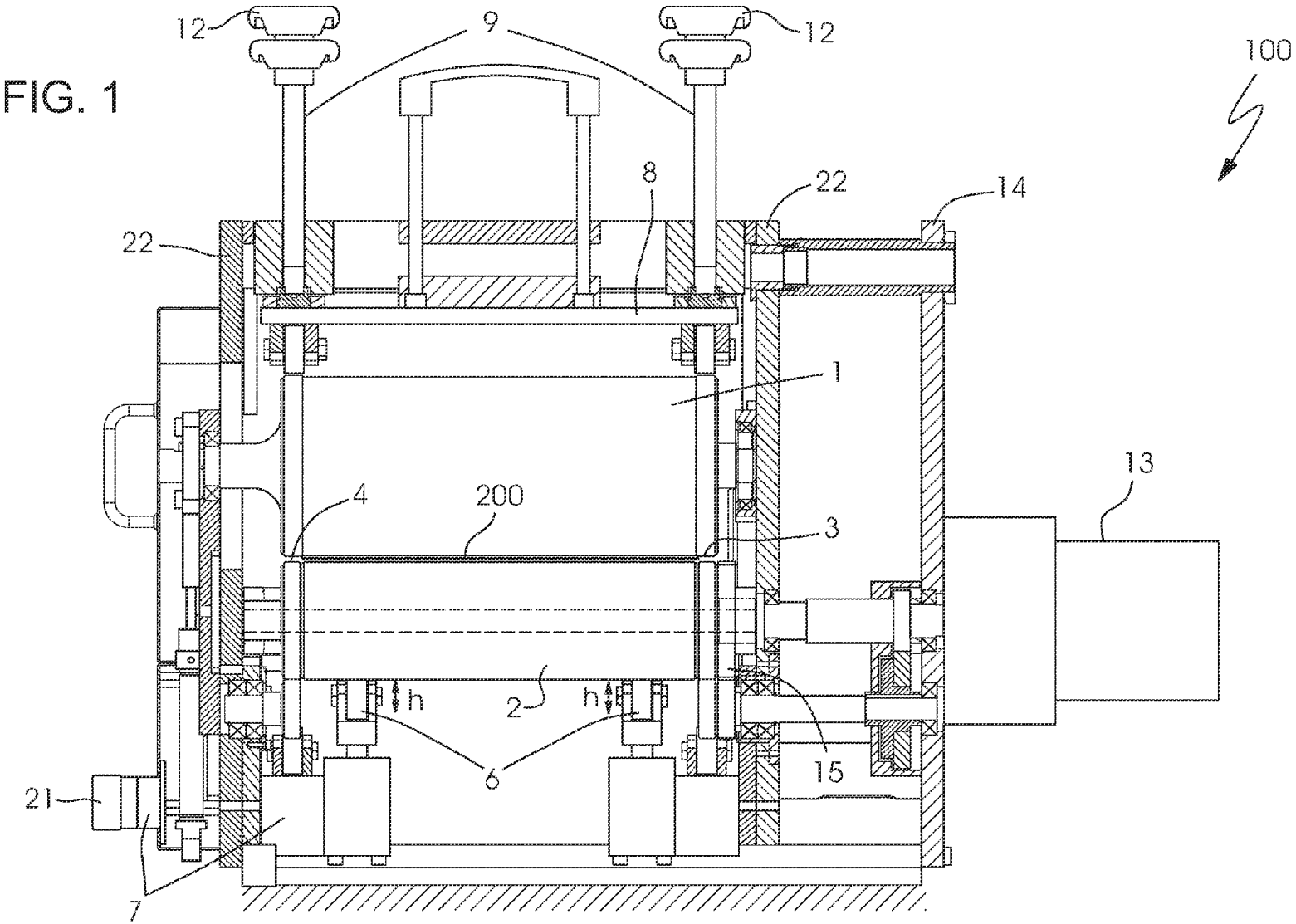
FIG. 1 is a diagrammatic, sectional view of a diecutting device according to the invention.

Referring now to the figures of the drawing in detail and first, particularly, to FIG. 1 thereof, there is shown a diagrammatic view of a diecutting device 100 of the invention, also referred to as diecutter or rotary diecutter. The diecutting device 100 contains a diecutting cylinder 1 and a counterpressure cylinder 2. A printing material 200 is passed between the diecutting cylinder 1 and the counterpressure cylinder 2 to receive a die-cut. The diecutting cylinder 1 and the counterpressure cylinder 2 are supported for rotation in side walls 22 of the diecutting device 100. Bearer rings 3, 4 are associated with the cylinders 1, 2. Thus the diecutting cylinder 1 has a respective bearer ring 3 on both of its outer ends. On the right and left sides of the counterpressure cylinder 2, bearer rings 4 are provided. The bearer rings 3 associated with the diecutting cylinder and the bearer rings 4 associated with the counterpressure cylinder roll off on each other. The bearer rings 4 absorb the diecutting forces from the diecutting cylinder 1 via the bearer rings 3 of the diecutting cylinder 1. The positioning of the diecutting cylinder 1 and of the counterpressure cylinder 2 is achieved by support roller blocks 8 and 6, respectively. Support roller block 8 is associated with the diecutting cylinder 1, and is provided with a pressure bridge 9. The preloading force of the pressure bridge 9 is adjustable via spindles 12 that are equipped with a respective turning knob. Support roller block 6 is associated with counterpressure cylinder 2 and includes two support roller pairs whose height is jointly or individually adjustable (h) by means of an adjustment device 7. Thus the counterpressure cylinder 2 is moved into engagement with the diecutting cylinder 1. The adjustment device 7 is driven by a drive 21 for varying the height of the support rollers. The drive 21 may be a small electric motor as shown. Alternatively or additionally, manual movement may be possible.

The diecutting cylinder 1 is driven by a drive motor 13 via a gear train 15. In the example given in FIG. 1, the drive motor 13 is arranged outside a housing 14 of the diecutter. It may, however, be arranged inside the housing 14 of the diecutter.

Figure 2:
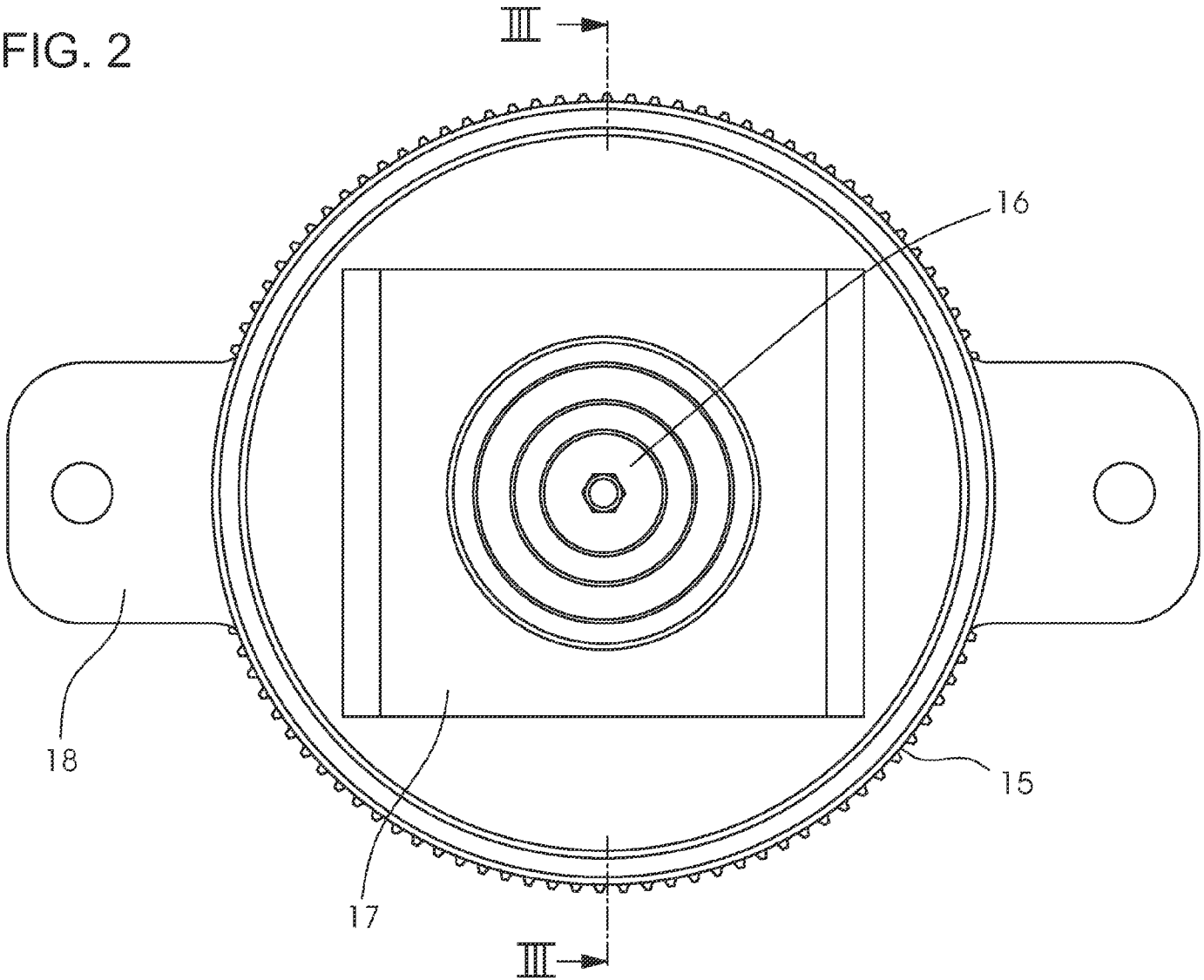
FIG. 2 is a side detailed view of an area of a counterpressure cylinder.

FIG. 2 is a view of the counterpressure cylinder 2, which is hidden by a gearwheel 15. What can be seen is a bearing 17 inserted in the side wall 22 of the housing 14 of the diecutter to receive a shaft 16 of the counterpressure cylinder 2. Another visible element is the mechanism 18 to prevent rotation, which will be described in more detail with reference to FIG. 4.

Figure 3:
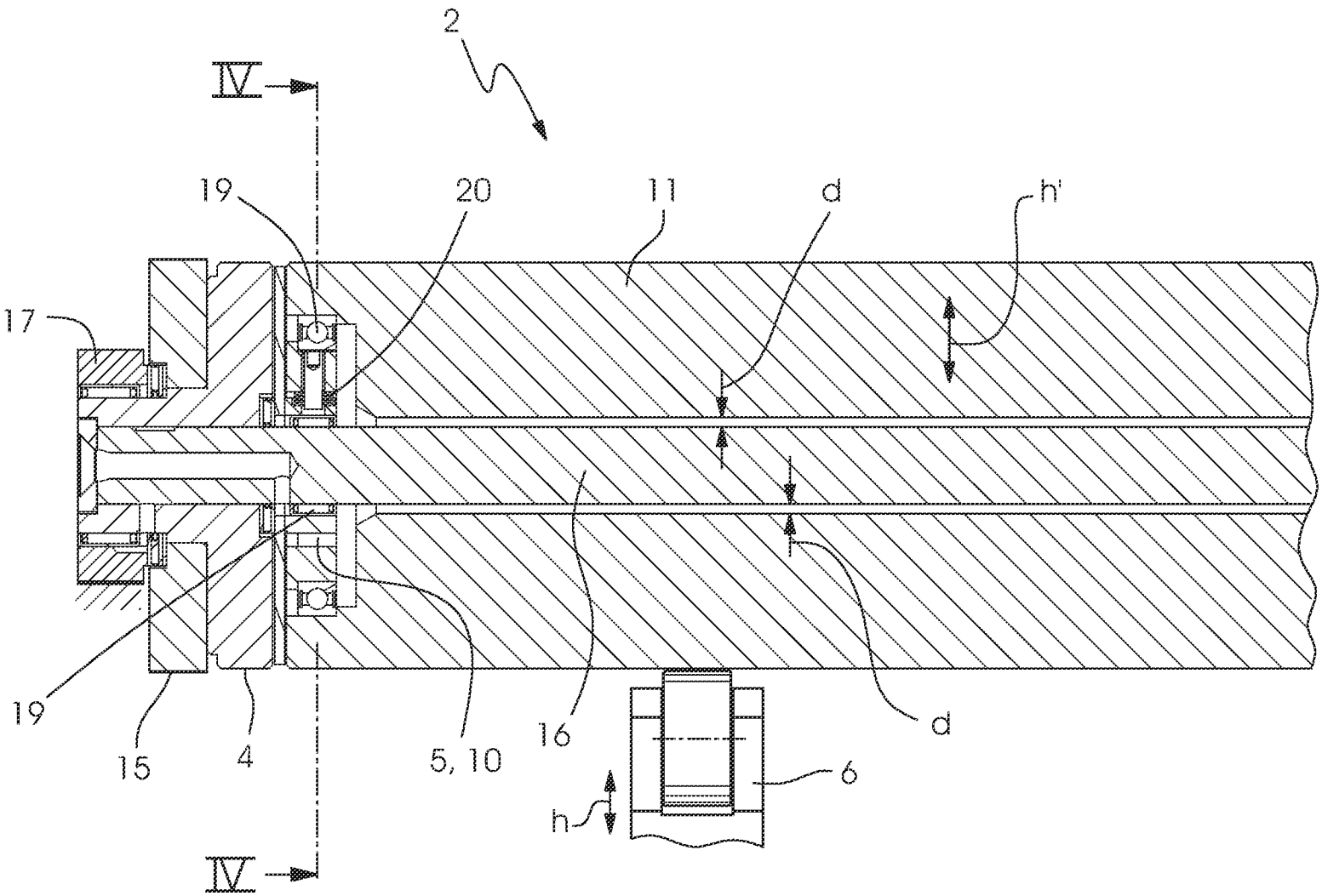
FIG. 3 is a sectional view of the counterpressure cylinder.

FIG. 3 is a sectional view of the counterpressure cylinder 2, which contains a sleeve-shaped cylinder body 11 in the form of a hollow cylinder. The central hole, i.e. the interior of the hollow cylinder 11 receives the shaft 16 of the counterpressure cylinder 2. The outer ends of the shaft 16 are supported in a bearing 17. A respective bearer ring 4 with a drive gearwheel 15 is flanged to each of the outer ends of the shaft 16. A connecting link guide 5, 10 connects the cylinder body 11 of the counterpressure cylinder 2 to the counterpressure cylinder shaft 16. The connecting link guide 5, 10 ensures that the cylinder body 11 is capable of being moved in the vertical direction to adjust the spacing between the counterpressure cylinder 2 and the diecutting cylinder 1. An adjustment h of the height of the support rollers of the support roller block 6 results in an adjustment h' of the cylinder body 11 of the counterpressure cylinder. The range of the height adjustment of the cylinder body 11 is determined by the spacing between the inner circumferential surface of the hollow cylinder 11 and the counterpressure cylinder shaft 16. In FIG. 3, the adjustment range is indicated by the letter "d".

To ensure that the cylinder body 11 permanently rests against the support rollers of the support roller block 6, a spring system including a set of Belleville spring washers 20 is provided in the bearing of the cylinder body 11. A roller bearing 19 ensures that the cylinder body 11 is freely rotatable relative to the shaft 16.

Since the counterpressure cylinder 2 is symmetrical, FIG. 3 illustrates only one half of the counterpressure cylinder 2. That is to say that a connecting link guide 5, 10 of analogous construction is provided at the non-illustrated other end of the counterpressure cylinder 2.

Figure 4:
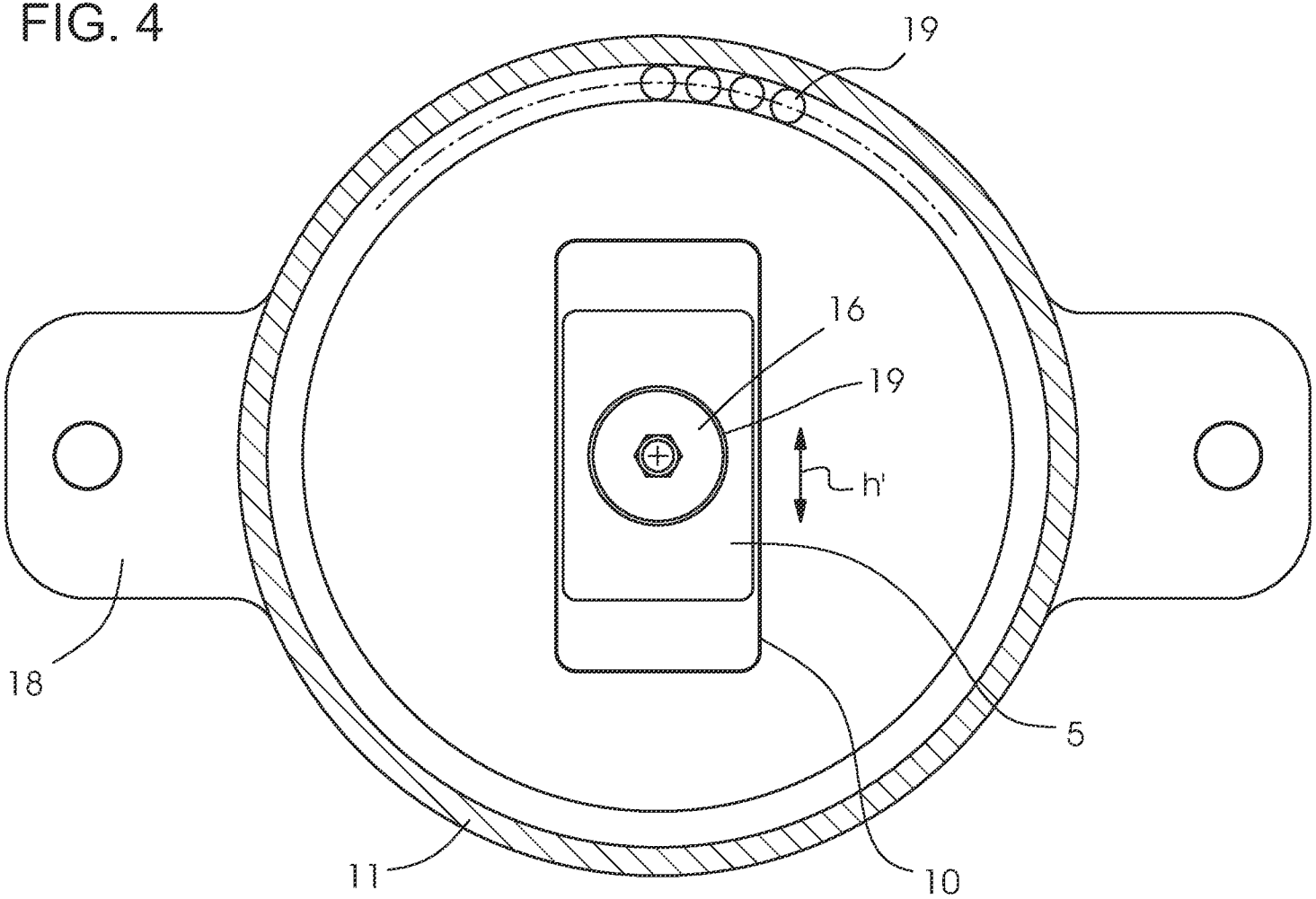
FIG. 4 is a sectional view of a connecting link guide of the counterpressure cylinder.

The construction of the connecting link guide 5, 10 is illustrated in more detail in FIG. 4. A sliding block 5 is mounted for rotation to the counterpressure cylinder shaft 16 by a roller bearing 19. The sliding block 5 is guided in a connecting link 10, which supports the cylinder body 11 of the counterpressure cylinder 2 for rotation. A mechanism 18 to prevent rotation ensure that the connecting link 10 does not rotate with the cylinder body 11 as the latter rotates and that the adjustment h' of the height of the counterpressure cylinder body 11 is made exclusively in the vertical direction.

When the spacing between the diecutting cylinder 1 and the cylinder body 11 of the counterpressure cylinder 2 is to be adjusted, the drive 21 for driving the height adjustment of the support rollers is actuated and a height adjustment h of the support roller pairs of the support roller block 6 is carried out by means of the adjustment device 7. This height adjustment h causes a height adjustment h' of the cylinder body 11 of the counterpressure cylinder 2 because due to the connecting link guide 5, 10, the cylinder body 11 is supported such that the cylinder body 11 is capable of carrying out a vertical movement relative to the counterpressure cylinder shaft 16. When both support roller blocks 6 experience the same height adjustment h, the adjustment of the cylinder body 11 relative to the diecutting cylinder 1 is parallel in terms of the axes of rotation. When the height adjustment h of the right-hand support roller block 6 is different from the height adjustment h of the left-hand support roller block 6, the cylinder body 11 is adjusted at an angle relative to the diecutting cylinder 1 in terms of their axes of rotation. When a quick disengagement between the counterpressure cylinder 2 and the diecutting cylinder 1 is desired, both support roller blocks are lowered by approximately 1 to 2 mm by means of the adjustment device 7.

In a non-illustrated alternative embodiment, sliding blocks that are supported to rotate are integrated into the bearer rings of the counterpressure cylinder. These sliding blocks are fixed against rotation relative to the housing of the diecutter. The sliding blocks in turn support the counterpressure cylinder body for rotation—in a manner analogous with the illustrated exemplary embodiment. The counterpressure cylinder body rests on two support roller blocks, which are jointly or individually adjustable in terms of their height and provide both parallel adjustment and angular adjustment of the counterpressure cylinder relative to the diecutting cylinder.

The invention claimed is:

1. A diecutting device, comprising:

a diecutting cylinder rotatable about a first axis of rotation;

a counterpressure cylinder rotatable about a second axis of rotation generally parallel to the first axis of rotation of said diecutting cylinder and having a cylinder body and a counterpressure cylinder shaft;

bearer rings assigned to both said diecutting cylinder and said counterpressure cylinder and rolling off on each other, a spacing between said diecutting cylinder and said counterpressure cylinder being adjustable, wherein a respective bearer ring assigned to said counterpressure cylinder is connected to said counterpressure cylinder shaft; and connecting link guides for adjusting spacing between said diecutting cylinder and said counterpressure cylinder, both ends of said cylinder body of said counterpressure cylinder connected to said counterpressure cylinder shaft of said connecting link guides.

2. The diecutting device according to claim 1, wherein said cylinder body is a hollow cylinder and said cylinder body is linearly displaceable relative to said counterpressure cylinder shaft.

3. The diecutting device according to claim 2, wherein said cylinder body is linearly displaceable relative to said counterpressure cylinder shaft in a vertical direction.

4. The diecutting device according to claim 1, further comprising at least two support roller blocks having support rollers for supporting said counterpressure cylinder, a spacing of said support rollers of said support roller blocks relative to said diecutting cylinder is variable to move said counterpressure cylinder towards said diecutting cylinder.

5. The diecutting device according to claim 4, further comprising a device for modifying a height of said support rollers of said support roller blocks, said device being operatable by motor or by hand.

6. The diecutting device according to claim 4, further comprising a spring system disposed in an area of a respective one of said connecting link guides, said spring system containing a set of Belleville washers, to prevent said counterpressure cylinder from lifting off said support rollers of said support roller blocks.

7. The diecutting device according to claim 4, further comprising a mechanism to prevent rotation and disposed in an area of said connecting link guides to prevent a connecting link guide from rotating.

8. The diecutting device according to claim 1, wherein said bearer rings assigned to said counterpressure cylinder are flanged to said counterpressure cylinder shaft so as to be fixed against rotation.

9. The diecutting device according to claim 1, wherein the diecutting device is configured for diecutting labels.

10. A diecutting device, comprising:

a diecutting cylinder rotatable about a first axis of rotation;

a counterpressure cylinder rotatable about a second axis of rotation generally parallel to the first axis of rotation of said diecutting cylinder and having a cylinder body and a counterpressure cylinder shaft;

bearer rings assigned to both said diecutting cylinder and said counterpressure cylinder and rolling off on each other, a spacing between said diecutting cylinder and said counterpressure cylinder being adjustable, wherein a respective bearer ring assigned to said counterpressure cylinder is connected to said counterpressure cylinder shaft; and connecting link guides for adjusting spacing between said diecutting cylinder and said counterpressure cylinder, both ends of said cylinder body of said counterpressure cylinder connected to said counterpressure cylinder shaft by said connecting link guides, each of said connecting link guides including a sliding block mounted for rotation to said counterpressure cylinder shaft and a connecting link for guiding said sliding block, said cylinder body of said counterpressure cylinder being supported for rotation relative to said connecting link.

11. The diecutting device according to claim 10, further comprising roller bearings each disposed between said counterpressure cylinder shaft and a respective said sliding block.

12. The diecutting device according to claim 10, further comprising roller bearings each disposed between a respective said sliding block and said cylinder body.

* * * * *